US009783332B2

(12) United States Patent
Untch et al.

(10) Patent No.: US 9,783,332 B2
(45) Date of Patent: Oct. 10, 2017

(54) FLEXIBLE CONTAINER AND FILLING DEVICE FOR SUCH A FLEXIBLE CONTAINER AND CORRESPONDING FILLING METHOD

(71) Applicant: FLECOTEC AG, Muellheim (DE)

(72) Inventors: Guenter Untch, Muellheim (DE); Martin Koch, Neuenburg (DE)

(73) Assignee: FLECOTEC AG, Muellheim (DE)

( * ) Notice: Subject to any disclaimer, the term of this patent is extended or adjusted under 35 U.S.C. 154(b) by 86 days.

(21) Appl. No.: 14/776,794

(22) PCT Filed: Mar. 14, 2014

(86) PCT No.: PCT/EP2014/055067

§ 371 (c)(1),
(2) Date: Sep. 15, 2015

(87) PCT Pub. No.: WO2014/140249

PCT Pub. Date: Sep. 18, 2014

(65) Prior Publication Data

US 2016/0031586 A1 Feb. 4, 2016

(30) Foreign Application Priority Data

Mar. 15, 2013 (DE) ..... 10 2013 204 602

(51) Int. Cl.
*B65D 1/42* (2006.01)
*B65D 30/10* (2006.01)
(Continued)

(52) U.S. Cl.
CPC ..... *B65D 1/42* (2013.01); *B65B 1/16* (2013.01); *B65B 67/1238* (2013.01); *B65D 31/16* (2013.01); *B65D 33/02* (2013.01)

(58) Field of Classification Search
CPC ..... B65D 1/42; B65D 31/16; B65D 33/02; B65D 31/02; B65D 31/04; B64B 67/1238
USPC ..... 220/639, 86.1; 141/1, 10, 114, 313–316; 53/486, 469, 468, 574, 449, 170, 553, 53/255; 383/109, 107, 120, 105, 119, 383/104
See application file for complete search history.

(56) References Cited

U.S. PATENT DOCUMENTS

| | | | | |
|---|---|---|---|---|
| 5,417,039 | A | 5/1995 | Hansson et al. | |
| 6,220,755 | B1 * | 4/2001 | Brown | B65D 88/1625 383/109 |
| 2012/0024419 | A1 * | 2/2012 | Behar | B65B 3/16 141/1 |

FOREIGN PATENT DOCUMENTS

| | | |
|---|---|---|
| DE | 88 05 713 | 6/1988 |
| EP | 0 567 743 | 11/1993 |
| GB | 2 241 220 | 8/1991 |

OTHER PUBLICATIONS

International Search Report (ISR) dated Jun. 12, 2014 in International (PCT) Application No. PCT/EP2014/055067.

* cited by examiner

*Primary Examiner* — Anthony Stashick
*Assistant Examiner* — James M Van Buskirk
(74) *Attorney, Agent, or Firm* — Wenderoth, Lind & Ponack, L.L.P.

(57) ABSTRACT

A flexible container (10.1; 10.2) has sealed connection to a process unit (20). A vacuum is applied to chambers (12, 22) opening into one another. A receptacle for a support apparatus (30.1; 30.2; 30.3) or the support apparatus (30.2) itself is arranged in or on the wall (14.1; 14.3) of the container (10.1; 10.2). A filling device (30) and a filling method for such a container are also provided.

18 Claims, 2 Drawing Sheets

(51) Int. Cl.

| | |
|---|---|
| ***B65D 33/02*** | (2006.01) |
| ***B65B 67/12*** | (2006.01) |
| ***B65B 1/16*** | (2006.01) |

FLEXIBLE CONTAINER AND FILLING DEVICE FOR SUCH A FLEXIBLE CONTAINER AND CORRESPONDING FILLING METHOD

FIELD OF THE INVENTION

The invention relates to a flexible container and to a filling device for such a flexible container and a corresponding filling method.

BACKGROUND OF THE INVENTION

A device for guiding plastic sacks at a filling station is known from G 88 05 713. That device fails to take into account or at least does not satisfactorily take into account a vacuum often prevalent in a process unit to be connected to the container.

The filling process of a flexible container from a process unit to which a vacuum is applied fails, in that no material falls into the flexible container, because known containers collapse as soon as the vacuum is present. For this reason, to date flexible containers are not used in such case or can only be used at great cost and effort.

SUMMARY OF THE INVENTION

The problem addressed by the invention is to provide an improved flexible container for connection to a process unit operating with a vacuum, and if possible, to provide a suitable filling method and an advantageous filling device.

The problem is solved according to the invention by a flexible container, a filling device and a filling method.

The flexible container and the process unit comprise chambers opening into one another, to which a vacuum is applied. The flexible container according to the invention includes a receptacle for a support apparatus and/or the support apparatus itself in or on the wall of the container.

The support apparatus assumes at least in this region, and in advantageous embodiments far into the inside of the container, a support function from the inside to the outside, and counteracts the otherwise imminent collapse.

According to one exemplary embodiment of the container according to the invention, the receptacle for the support apparatus extends in the circumferential direction and/or in the axial direction, viewed from a perspective having an axial direction oriented in the filling direction.

According to another advantageous embodiment of the container according to the invention, the support apparatus is an elongated pipe socket, around which the flexible container is gathered. In this arrangement, the entire container accommodates the support apparatus.

According to another advantageous embodiment of the container according to the invention, the receptacle for the support apparatus extends in pockets formed in or on the wall.

According to another advantageous embodiment of the container according to the invention, the wall is designed at least in sections as a double wall. The wall is intended to accommodate the support apparatus between an inner wall and an outer wall.

According to another advantageous embodiment of the container according to the invention, the pockets are formed by welding sections of the inner wall to the outer wall in the circumferential direction or radial direction.

A filling device according to the invention for such a flexible container is equipped with a support apparatus, which can be accommodated in the flexible container.

A filling method according to the invention for such a flexible container includes the following method features. The container may be connected to a process unit operated with a vacuum. A support apparatus holds the container open against the forces of the vacuum acting inwardly on the wall of the container.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure and that are schematic.

DETAILED DESCRIPTION OF THE INVENTION

Figure 1:
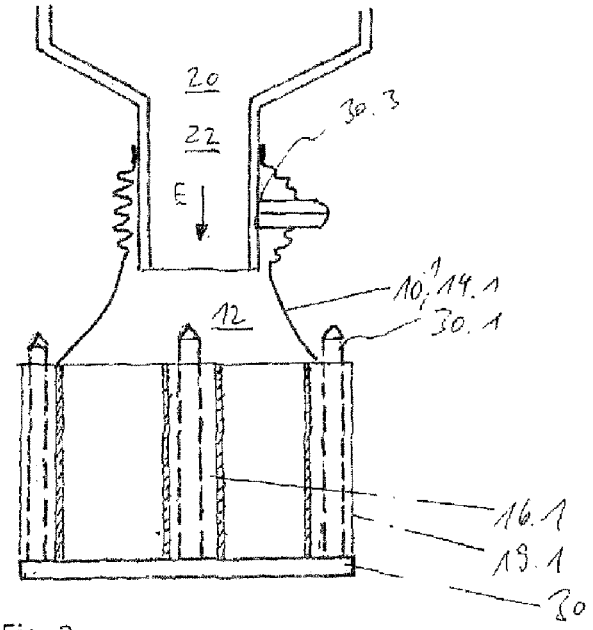
FIG. 1 is a schematic side view of a flexible container connected to a process unit for filing according to a filling method accommodated in a filling device according to a first exemplary embodiment of the invention.
Figure 2:
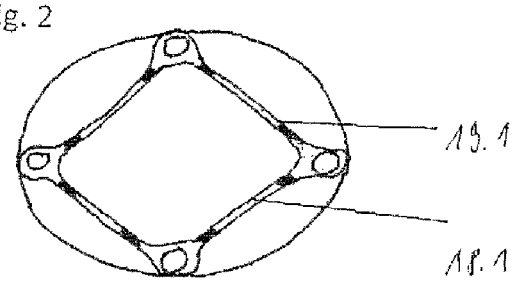
FIG. 2 is a schematic top view of the container of FIG. 1.

FIGS. 1 and 2 are to be understood, in principle, as a side view (FIG. 1) and a top view (FIG. 2) depicted in accordance with drafting standards (projection rule).

FIGS. 1 and 2 show a first exemplary embodiment of a container 10.1 according to the invention. The container is connected at its top to a process unit 20 that applies a vacuum, and, at the base, accommodates a filling device 30.

In this arrangement, the flexible container 10.1 according to the first embodiment encompasses a first support apparatus 30.3 at the top. That support apparatus is a pipe socket of the process unit 20 designed of sufficient length and protruding further than normal into the inside of the container. The solution to the connection problem, in which reciprocally interlocking plastic closure strips are used, is particularly advantageous.

The base of the flexible container according to the first exemplary embodiment includes axial pockets 16.1, i.e. oriented along a filling direction E. The axially extending pockets accommodate rods of a second support apparatus 30.1. The rods are distributed over or around the circumference of the container. The pockets 16.1 are formed inside the wall 14.1. For this purpose, the wall 14.1 includes a laterally closed inner well, especially clearly visible in FIG. 2, which may also be referred to as an inner container, and an outer wall 19.1, which may be a section of tubular film disposed on the outside. The walls 18.1, 19.1 are welded together along axial lines. Preferably, polyethylene films are combined with one another.

Figure 3:
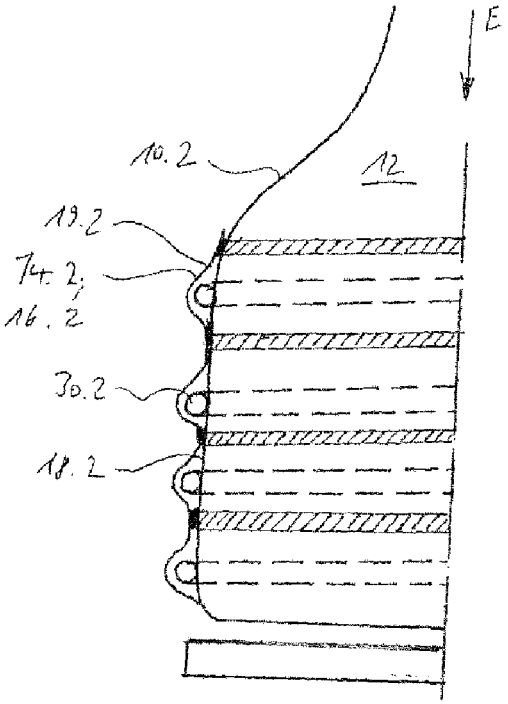
FIG. 3 is a schematic side view in section of a container according to a second exemplary embodiment of the invention.

FIG. 3 depicts schematically and corresponding more to an axial section, a second exemplary embodiment of a flexible container 10.2 according to the invention. Chamber 12 to be filled in the filling direction E is braced in the circumferential direction by the support apparatus 30.2 disposed here. For this purpose, the support apparatus 30.2, as part of the container 10.2, is disposed in circumferential, in particular, spiral-shaped, circumferential pocket(s) 14.2.

When manufacturing a container according to the second exemplary embodiment, is the spiral-shaped configuration can be welded to the inner wall 18.2 continuously to the outer wall 19.2.

While various embodiments have been chosen to illustrate the invention, it will be understood by those skilled in the art that various changes and modifications can be made therein without departing from the scope of the invention as defined in the claims.

The invention claimed is:

1. A flexible container connectable to a process unit applying a vacuum, the flexible container comprising:

a receptacle having an inner wall including a top portion connectable and sealable to a first support that is receivable in said top portion with partial volumes of the process unit and the receptacle opening into one another in fluid communication, said inner wall defining a laterally closed interior;

a plurality of pockets at least one of in said inner wall or on an exterior surface of said inner wall, said pockets being unconnected in fluid communication with said interior and having with openings accessible from outside of the container with said pockets adapted to receive pins of a support through said openings preventing collapse of the container when a vacuum is applied to an interior of the container.

2. A flexible container according to claim 1 wherein said pockets extend parallel to a longitudinal axis of said inner wall and have bottom openings on bottom ends of said pockets and exposed on said exterior surface, said bottom openings being adapted for insertion of the pins into and removal of the pins from said pockets through said bottom openings.

3. A flexible container according to claim 1 wherein said pockets are on an exterior surface of said inner wall.

4. A flexible container according to claim 2 wherein said pockets have top openings adapted to allow the pins to extend through said top openings of said pockets.

5. A flexible container according to claim 1 wherein said pockets are defined by said inner wall and an outer wall.

6. A flexible container according to claim 5 wherein said outer wall is welded to said inner wall.

7. A filing system, comprising:

a process unit having an elongated pipe socket, a vacuum generator and a content filler;

a flexible container having an inner wall with a top end opening surrounding and being sealed to said pipe socket, said inner wall defining a closed interior except for said top end opening and receiving a vacuum pressure from said vacuum generator and contents from said content filler;

a plurality of pockets at least one of in said inner wall or on an exterior surface of said inner wall, said pockets being unconnected in fluid communication with said closed interior and having openings accessible from outside of the container; and a support retaining said flexible container against collapsing when said closed interior is subjected to the vacuum pressure, said support includes a plurality of pins received in said pockets.

8. A filling system according to claim 7 wherein said pockets extend parallel to a longitudinal axis of said inner wall and have bottom openings on bottom ends of said pockets and exposed on said exterior surface, said pins being inserted into and removed from said pockets through said bottom openings.

9. A filing system according to claim 8 wherein top ends of said pins are axially tapered.

10. A filling system according to claim 9 wherein said pockets have top openings, said pins extending through said top openings of said pockets.

11. A filling system according to claim 7 wherein said pockets are defined by said inner wall and an outer wall.

12. A filling system according to claim 11 wherein said outer wall is welded to said inner wall.

13. A method of filling a container, comprising the steps of:

connecting a flexible container to an elongated pipe socket of a process unit by a top end opening of the flexible container being placed to surround and sealed about the pipe socket, the flexible container having an inner wall defining a closed interior except for the top end opening;

supporting and retaining the flexible container against collapsing while the closed interior is subjected to a vacuum pressure by a vacuum generator in the process unit, the supporting and retaining of the flexible container being accomplished by inserting a plurality of pins in a plurality of pockets at least one of in the inner wall or on an exterior surface of the inner wall with the pockets being unconnected in fluid communication with the closed interior and with the pins being inserted through openings accessible from outside the container; and filling the container from a content filler in the process unit while the flexible container is supported and retained and is subjected to the vacuum pressure.

14. A method according to claim 13 wherein the pockets extend parallel to a longitudinal axis of the inner wall and have bottom openings on bottom ends of the pockets and exposed on the exterior surface, the pins being inserted into and removed from the pockets through the bottom openings.

15. A method according to claim 14 wherein top ends of the pins are axially tapered.

16. A method according to claim 15 wherein the pockets have top openings, with the pins being extended through the top openings of the pockets.

17. A method according to claim 13 wherein the pockets are defined by the inner wall and an outer wall.

18. A method according to claim 17 wherein the outer wall is welded to the inner wall.

* * * * *